US005533934A

United States Patent [19]

Miller

[11] Patent Number: 5,533,934

[45] Date of Patent: Jul. 9, 1996

[54] CHILD SAFETY SWING FOR PLAYGROUND SWING

[76] Inventor: Rene M. Miller, 11446 NE. Fremont Ct., Portland, Oreg. 97220

[21] Appl. No.: 166,508

[22] Filed: Dec. 13, 1993

[51] Int. Cl.[6] ..... A63G 9/00

[52] U.S. Cl. ..... 472/118

[58] Field of Search ..... 472/118; 297/452.1, 297/467, 273

[56] References Cited

U.S. PATENT DOCUMENTS

| | | | |
|---|---|---|---|
| D. 226,489 | 3/1973 | Kimble | 472/118 X |
| 3,256,016 | 6/1966 | Berlin | 472/118 |
| 4,382,595 | 5/1983 | Tolar | 472/118 |
| 4,706,952 | 11/1987 | Shannon | 472/118 |
| 5,161,522 | 11/1992 | Clevenger | 472/118 X |
| 5,201,693 | 4/1993 | Sparkes | 472/118 X |
| 5,334,099 | 8/1994 | Marra | 472/118 |

FOREIGN PATENT DOCUMENTS

| | | | |
|---|---|---|---|
| 1255733 | 1/1961 | France | 472/118 |
| 216933 | 6/1924 | United Kingdom | 472/118 |

*Primary Examiner*—Carl D. Friedman
*Assistant Examiner*—Beth A. Aubrey
*Attorney, Agent, or Firm*—Keith A. Cushing

[57] ABSTRACT

A child safety device is shown and described for converting a belt seat playground swing into a child seat safety swing. The device includes an attachment mechanism for securing the device to the chains of a belt seat playground swing and includes a waist strap for encircling the child's body to prevent the small child from tipping forward or backward from the belt seat swing. Additional structures include under straps and crotch straps and mesh netting all securely stitched together to complete a child receiving cavity. The child's weight bears upon the belt seat of the swing, and the safety device secures the child in such position upon the belt seat swing. The device is compact and portable and may be carried along with other child related paraphernalia.

14 Claims, 4 Drawing Sheets

CHILD SAFETY SWING FOR PLAYGROUND SWING

BACKGROUND OF THE INVENTION

The present invention relates generally to child safety apparatus, and particularly to an attachment for a playground swing making such swing suitable for use by small children.

Public playgrounds are generally designed for children in the range of 5 to 12 years old. Unfortunately, many children younger than 5 years old frequent playgrounds. Such younger children cannot use all the equipment for lack of appropriate safety features.

Since 1981, when the United States Consumer Products Safety Commission (CPSC) issued a handbook for public playground safety, national and local publications have published articles, hundreds of professionals have held seminars across the country, prestigious newspapers have addressed playground safety, and national television networks have covered this important issue. These educational efforts have made the public more aware of the safety problems presented on public playgrounds. The continued level of injury and the rising number of lawsuits, however, have made clear that present solutions to playground safety are not fully adequate. Accordingly, any improvement to safety features of playground equipment should be considered an advance in the industry.

It is likely that there are as many preschoolers using playground equipment with parents in the public parks, and after school hours on school playgrounds, then children in the age range of 5 to 12 years using the playground equipment. This conclusion may be inferred from the injury data provided by CPSC. Injuries suffered on playground equipments have sent more than 237,000 children to hospital emergency rooms in 1990 alone, according to the National Electronic Injury Surveillance System of the United States Consumer Product Safety Commission in Washington, D.C. It is estimated that twice this number of injuries go unreported. The Consumer Product Safety Commission hazard analysis shown that falls to the ground surface account for 60% of playground equipment relates injuries. A one foot fall directly on the head onto concrete or asphalt, or a four foot fall onto packed earth, can be fatal to a child.

To address the needs of the many children ages 1 through 5 who may use the playground equipment in our public playgrounds there exists a need to improve safety conditions in use of such equipment. In particular, the subject matter of the present invention concerns improvement to safety conditions in use of playground swings.

FIG. 1 illustrates a conventional playground swing set 10 including belt seat swings 12 and a child swing 14. Belt seat swings 12 include a belt or strap 12*a* connected at each end to corresponding chains 12*b*. For older children, e.g., 5 to 12 years old, the belt seat swings 12 are perfectly suitable for enjoyable use of swing set 10. Belt seat swings 12 do not, however, accommodate younger children. In particular, belt seat swings 12 do not provide any restraint against the child tipping forward or backward out of the swing. Accordingly, the child seat swing 14 is typically found on public playground swing sets. A child seat swing is characterized by a seat portion 14 including a backrest 14*a* and a belt portion 14*b*. Once the child is seated in the child seat swing, the belt portion 14*b* is attached to provide a closure about the child's upper waist with the feet hanging forward of the swing. In this manner, a small child can enjoy use of the swing set 10 without risk of falling from the child seat swing 14.

Playground swing sets include many belt seat swings 12 for older children, but typically only one or two child seat swings 14 for smaller children. With the large number of younger children wishing to use such child seat swings, however, it is typical for the parent to find all such child seat swings occupied. Accordingly, the younger children often must wait their turn to use the child seat swings. As may be appreciated by those parents having young children in the age range 1 to 5, it is often difficult for the children to remain patient while waiting for a child seat swing 14 to become available for use.

Accordingly, it would be desirable to provide a safe alternative to the child seat swings 14 when the child seat swings 14 are not available. Such apparatus should be secure enough to provide a high degree of safety for the young child while in enjoying the swing activity.

SUMMARY OF THE INVENTION

In accordance with a preferred embodiment of the present invention, a belt seat swing is converted into a child safety seat swing by attachment of a portable, compact safety device to the belt seat swing. The attachment device under the present invention includes two clip elements attachable to the supporting chain of the belt seat swing to provide a retention cavity for the child sitting directly on the belt seat. In particular, the retention mechanism includes at least one strap, possibly including a buckle portion, encircling the child's upper waist or mid-back to prevent the child from tipping forward or backward off the belt seat swing. The device may further include additional supporting straps front-to-back through the crotch and left-to-right under the buttocks, and also a mesh panel to complete the retention cavity.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
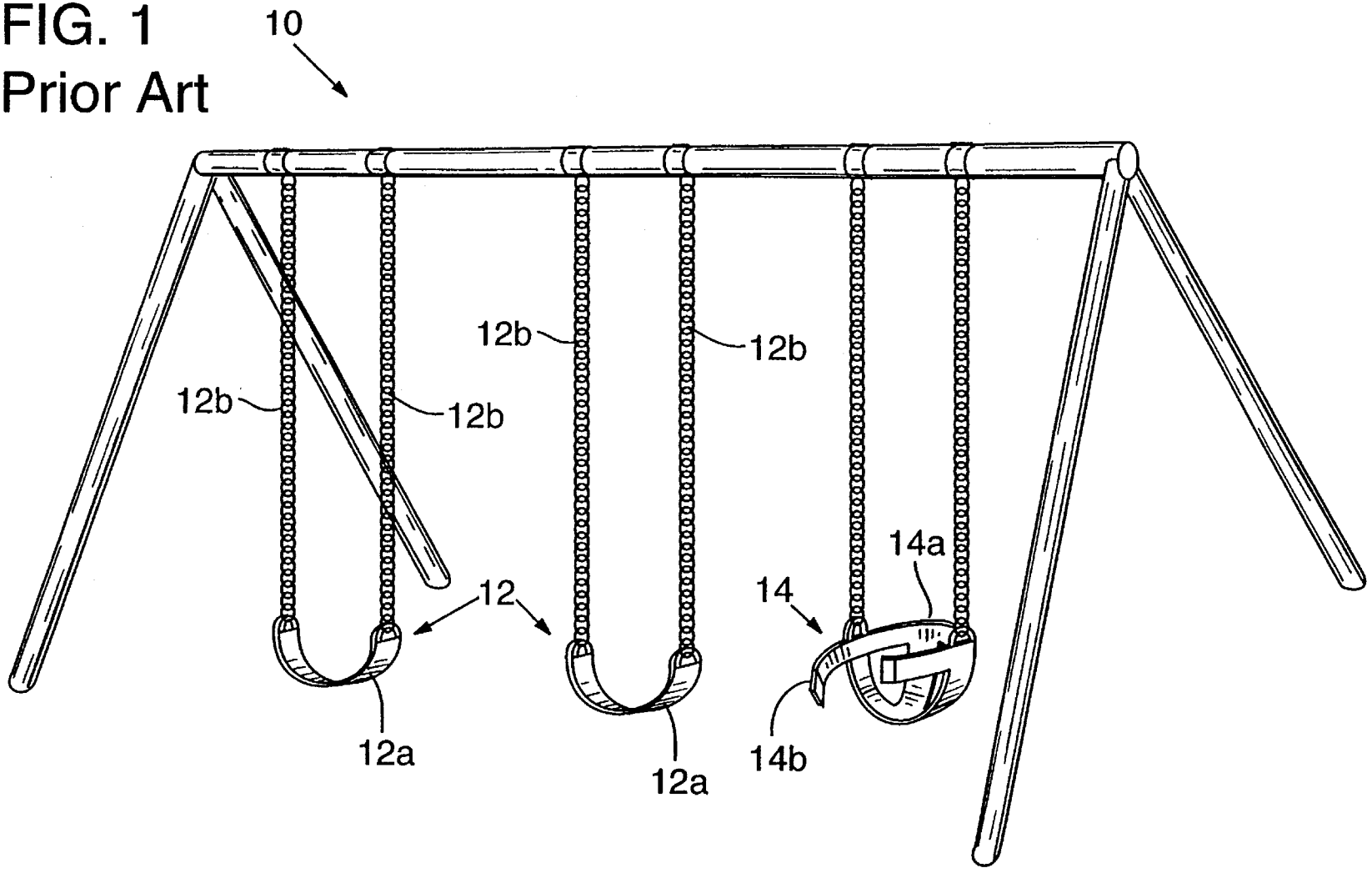
FIG. 1 Prior Art
FIG. 1 illustrates a conventional, prior art playground swing set including belt seat swings and a child seat swing.

The preferred embodiment of the present invention as illustrated in the drawings comprises generally a structure defining a child receiving cavity and attachable to a conventional playground swing, e.g., a belt seat swing 12 (FIG. 1), to convert the playground swing into a child safety seat swing and prevent the child from falling from the swing during play. The device may be constructed of strong webbing and mesh materials with substantial stitching provided to form the device in a secure and structurally reliable fashion. The device may be conveniently rolled into small compact form for portability along with other child related accessories, e.g., can be carried in a diaper bag.

Figure 2:
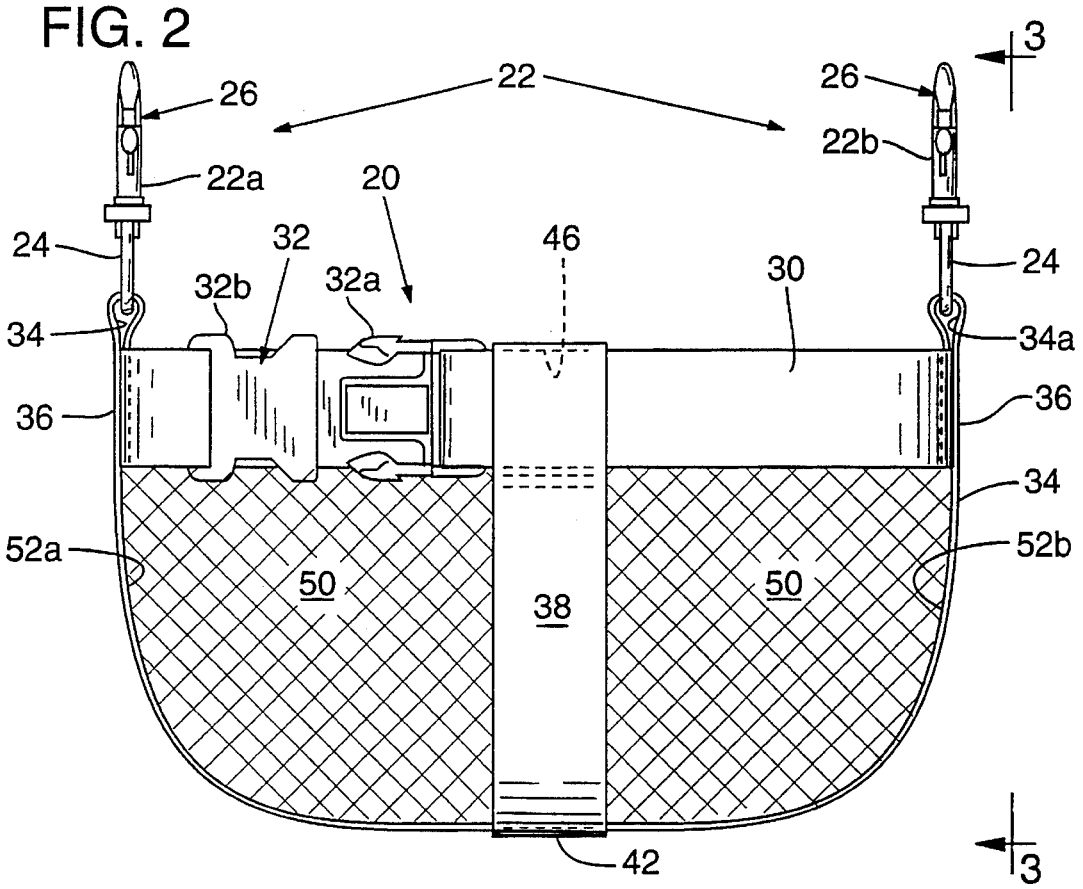
FIG. 2 is a front view of a child safety swing attachment device according to a preferred embodiment of the present invention.
Figure 3:
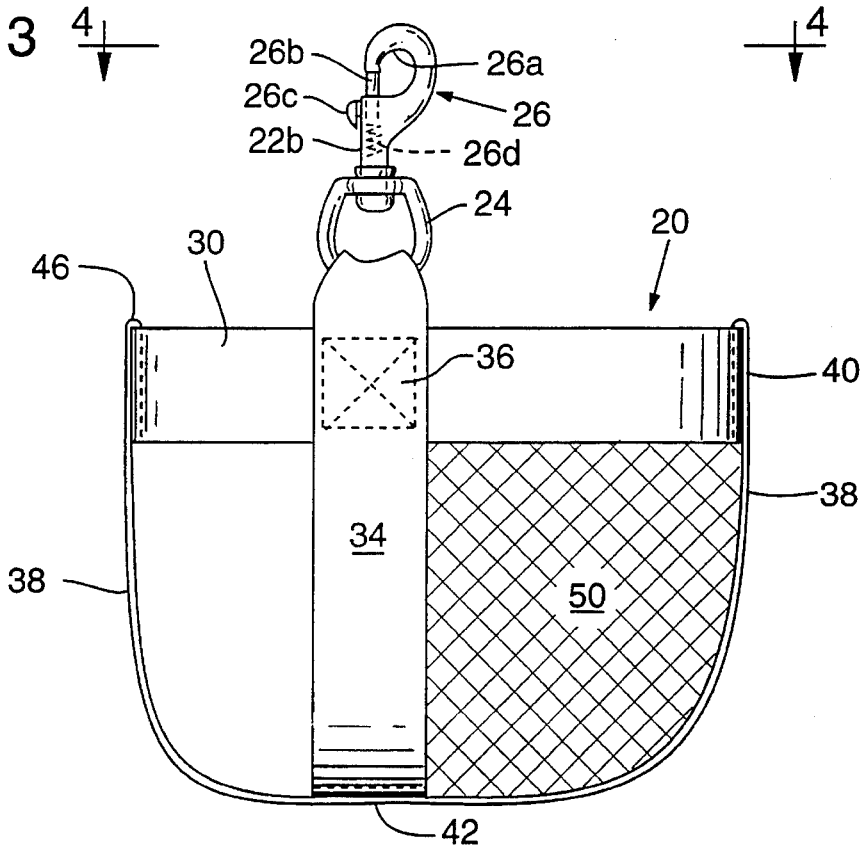
FIG. 3 is a side view of the device of FIG. 2 as taken along lines 3—3 of FIG. 2.
Figure 4:
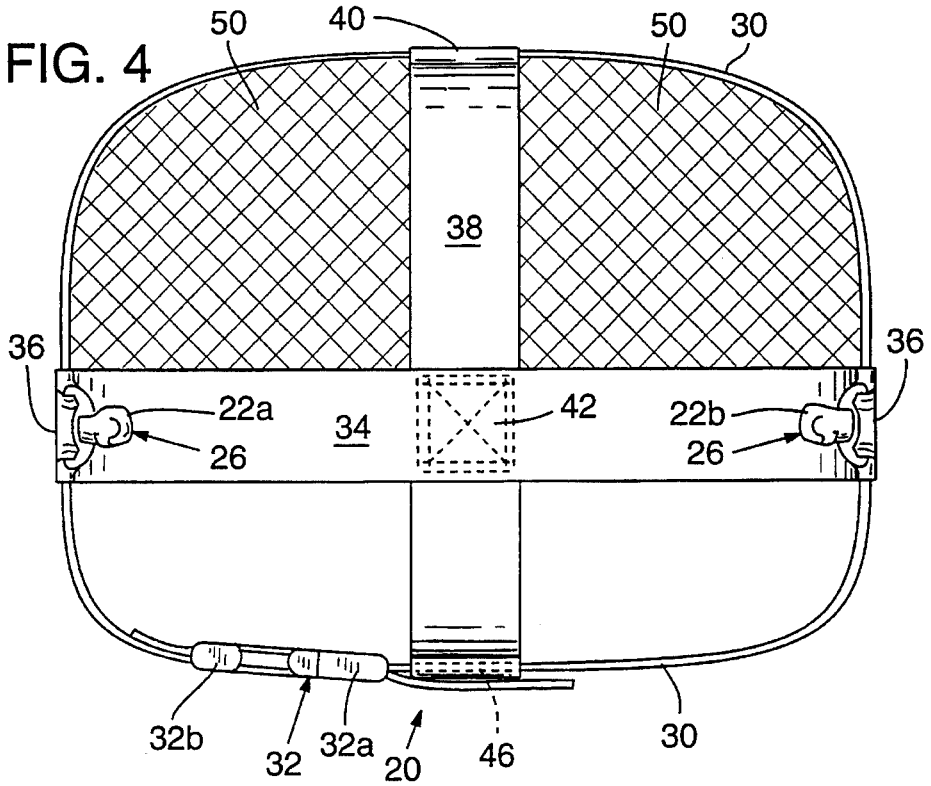
FIG. 4 is a top view of the device as taken along lines 4—4 of FIG. 3.

With reference to FIGS. 2–4, the safety device of the present invention takes generally the form of a fabric retention cavity 20 and an attachment arrangement 22. The attachment arrangement 22 includes a pair of swivel hooks 22*a* and 22*b*. Each hook 22 includes a closed ring 24 upon which a snap 26 attaches rotatably. Each snap 26 includes a hook structure 26*a* and a closure pin 26*b*. The closure pin 26*b* slides within the body of snap 26 and closes the hook structure 26*a*. Each pin 26*b* is biased toward its closed position and may be operated by sliding the attached slide button 26*c*. Spring 26*d* (FIG. 3) maintains the pin 26*c* against the hook structure 26*a*, unless retracted by operation of the button 26*c*. As discussed more fully hereafter, swivel hooks 22*a* and 22*b* attach to the chains 12*b* (FIG. 1) of a conventional belt seat swing 12*a* so as to position the retention cavity 20 at the belt seat 12*a*.

Retention cavity 20 is defined generally at its upward facing opening by a mid-back or waist strap 30. Waist strap 30 is of sufficient length to encircle the child's mid-back or upper waist and includes a buckle 32 at a front portion thereof. Buckle 32 may include a clip portion 32*a* and a receptacle portion 32*b*. An under strap 34 includes at each end a loop 34*a* engaging the ring 24 of a swivel hook 22. In particular, each end of strap 34 is inserted through the ring 24, folded back onto itself, and attached by stitching thereat. In this manner, the swivel hooks 22*a* and 22*b* are well secured to each end of strap 34. Also, straps 30 and 34 are sewn together at their areas of intersection 36. A crotch strap 38 is sewn fixedly at the rear portion of strap 30, i.e., at the intersection 40 between straps 30 and 38. Strap 38 extends downward along the rear of cavity 20 across the bottom of cavity 20, past the bottom-most portion of strap 34 and upward toward the front portion of strap 30. The intersection 42 of straps 34 and 38 is securely sewn together. The front end of strap 38 is folded upon itself to define a loop 46 through which slidably passes the front portion of strap 30. A mesh 50 completes the child retaining cavity 20. Mesh 50 occupies the area between under strap 34 and the rear portion of waist strap 30, leaving open the area forward of under strap 34. Thus, under strap 34 and crotch strap 38 define right and left leg openings 52*a* and 52*b*. As may be appreciated, construction of the mesh 50 to complete, in conjunction with the straps 30, 34, and 38, a child receiving cavity may require darts (not shown) to provide a rounded concave area for receiving the child's buttocks.

In the preferred form of the present invention the straps 30, 34, and 38 are nylon webbing two inches wide and of substantial strength, e.g., able to withstand 650 pounds per square inch stress. The mesh 50 is preferably a 100% polyester fabric mesh having a high tear strength and ability to securely attach to straps 30, 34 and 38 by stitching thereto. As may be appreciated, the specific stitching and coupling of mesh 50 and straps 30, 34, and 38 may take a variety of forms, but in each case should establish a structurally secure child receiving cavity 20 which may be supported from above by means of swivel hooks 22.

Figure 5:
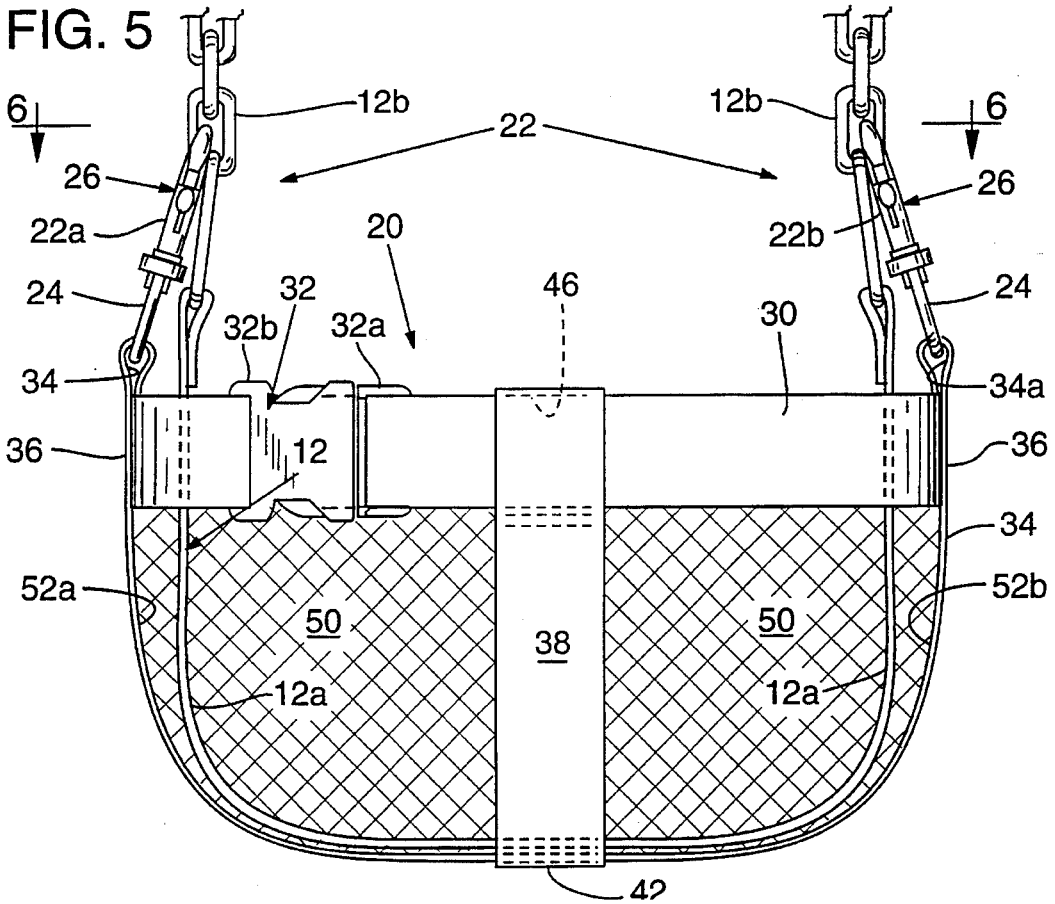
FIG. 5 shows the safety swing attachment device of the present invention attached to a conventional belt seat swing as contemplated for use.
Figure 6:
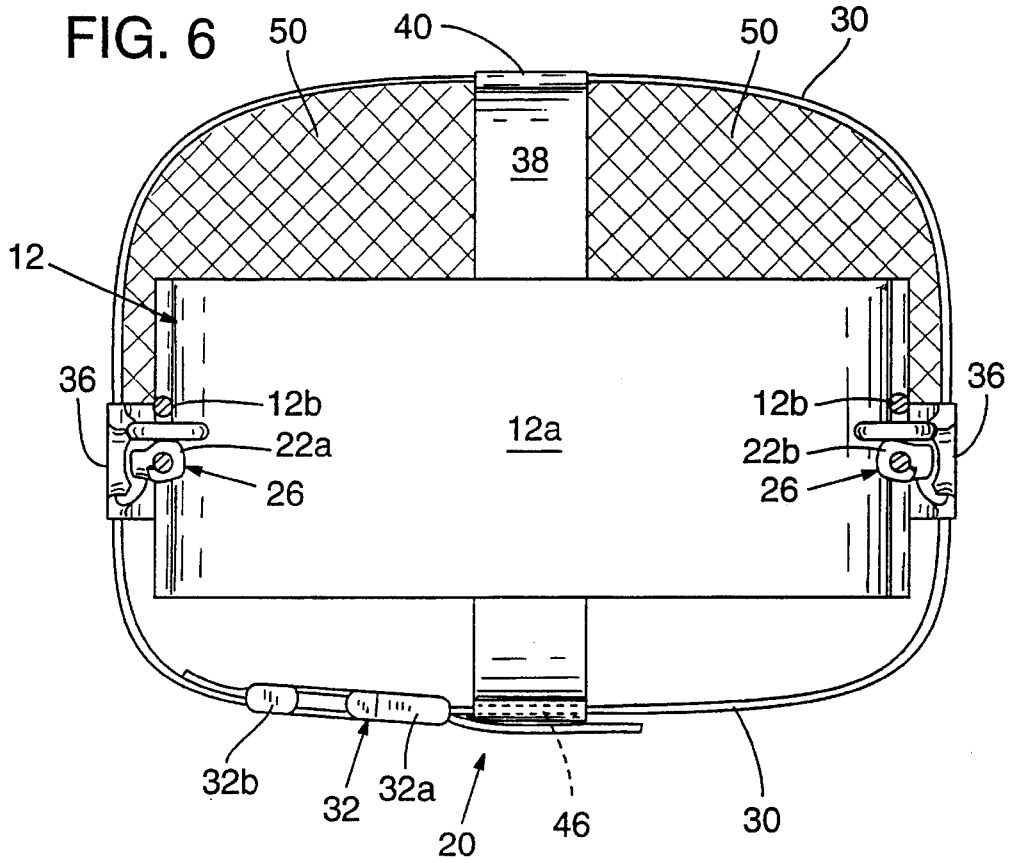
FIG. 6 is a top view of the arrangement of FIG. 5 showing the interior child-receiving portion of the device.

FIGS. 5 and 6 illustrate the safety device of the present invention as illustrated in FIGS. 2–4 attached to a conventional belt seat swing 12. In FIGS. 5 and 6, the clips 22*a* and 22*b* attach to the chains 12*b* of belt seat swing 12 and the belt seat 12*a* resides within the cavity 20. To attach the safety swing device, the device is raised from below belt seat 12*a* to bring belt seat 12*a* into cavity 20. The device is then raised sufficient height to place belt seat 12*a* along the bottom of cavity 20. Swivel hooks 22*a* and 22*b* are attached to respective ones of chains 12*b*. The child is then placed in the cavity 20 with legs extending through leg openings 52*a* and 52*b*. The buckle 32 may be open to facilitate placement of the child within the cavity 20, and may also be used to tighten the waist strap 30 to more suitably fit the child. In this manner, the normal width of belt seat 12*b* may be substantially reduced to reduce lateral freedom of movement for the child, and therefore reduce the possibility of the child falling from the cavity 20. The child's weight bears directly on the belt seat 12*a*. The waist strap 30 remains securely in position about the child's body, i.e., at least upper waist and preferably mid-back, to prevent the child from falling from the belt seat 12*a*. Thus, the safety device of the present invention quickly and conveniently converts a conventional belt seat swing to a child seat swing.

Figure 7:
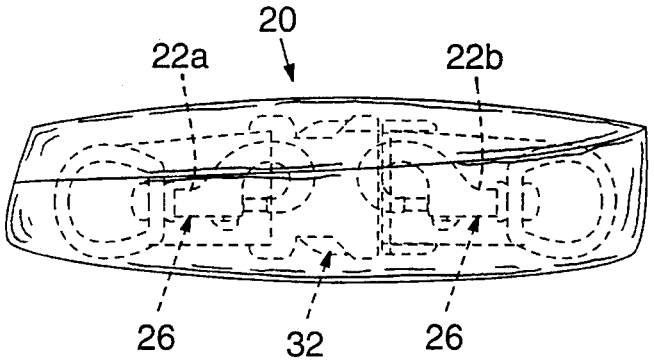
FIG. 7 illustrates the device of the present invention as rolled into a compact and portable form for transport as a personal child accessory to and from the playground.

FIG. 7 illustrates the portability of the present invention. In FIG. 7, the strap and mesh construction of the safety device of the present invention allows the device to be rolled into a compact form, with the swivel hooks 22*a* and 22*b* secured within the rolled configuration. As may be appreciated, such portability allows the device to be carried along with other child related accessories. Thus, a parent taking a child to a playground but finding all the child seat swings occupied, may conveniently use the safety device of the present invention to convert an available belt seat type swing to a safe and secure playground apparatus for use.

Thus, an improvement to child safety apparatus has been shown and described. The present invention advances playground safety equipment by providing a convenient, portable safety device for attachment to a conventional belt seat swing making the conventional belt seat swing suitable, i.e., safe, for use by small children. Because the device is portable and may be rolled into compact configuration, the device of the present invention may be easily incorporated into an inventory of child related accessories carried by a parent, especially when making excursions to the playground. When faced with a lack of available conventional child seat swings 14 (FIG. 1), the parent simply removes the portable safety device of the present invention and attaches it to a conventional belt seat swing 12 (FIG. 1) to convert that belt seat swing into a safe swing. Thus, the child need not wait for a next available conventional child safety seat swing 14, but can more immediately enjoy the pleasure of swinging.

It will be appreciated that the present invention is not restricted to the particular embodiment that has been described and illustrated, and that variations may be made therein without departing from the scope of the invention as found in the appended claims and equivalents thereof.

What is claimed is:

1. A method of converting a playground swing into a child safety seat swing, the playground swing including a belt seat depending from a swing set structure by a pair of chains, the method comprising the steps:

providing a structure defining a child receiving cavity and including at least a waist belt defining an upper opening of said cavity; and attaching said structure to said pair of chains to establish vertical support for said structure and to position within said child receiving cavity said belt seat and allow a child to sit within said cavity restrained from falling forward or backward by way of said waist belt.

2. A method according to claim 1 wherein said method includes placing said belt seat within said cavity whereby said method includes placing the weight of said child directly upon said belt seat.

3. A method according to claim 1 wherein said method includes carrying the weight of said child upon said belt seat.

4. A method according to claim 1 wherein said method includes as a preliminary step carrying said structure in a compact form to a playground at which said playground swing is located.

5. A method according to claim 4 wherein said compact form is a rolled configuration of substantially smaller size than that of the device when in use attached to said pair of chains.

6. A method according to claim 1 wherein said step of attaching comprises the step of providing first and second clip elements of said structure and coupling said first and second clip elements to each one of said pair of chains, respectively.

7. A safety attachment in combination with a playground swing, the swing including a belt seat depending from a swing set structure by a pair of chains, the safety attachment comprising:

a restraint structure defining a child receiving cavity and including at least a waist belt defining an upper opening of said cavity; and an attachment mechanism coupling said restraint structure to said chains to vertically support said structure therefrom and to position said cavity at said belt seat in such manner to restrict falling movement of a child residing within said cavity.

8. An attachment according to claim 7 wherein said attachment mechanism comprises clip means selectively attachable along the length of said chains.

9. A safety attachment for a playground swing, the swing including a belt seat depending from a swing set structure by a pair of chains, the safety attachment comprising:

a restraint structure defining a child receiving cavity and including at least a waist belt defining an upper opening of said cavity;

an attachment mechanism coupling said restraint structure to said chains to position said cavity at said belt seat in such manner to restrict falling movement of a child residing within said cavity; and a front-to-rear crotch strap coupled at a first end thereof to a rear portion of said waist belt and coupled at a second end thereof to a front portion of said waist belt.

10. An attachment according to claim 9 wherein said coupling of said second end of said crotch strap to said waist belt is by slidable relationship allowing relative movement between said waist belt and said crotch belt.

11. An attachment according to claim 9 further comprising an under belt coupled at a first end thereof to a left portion of said waist belt and coupled at a second end thereof to a right portion of said waist belt wherein said first and second ends of said under belt couple to said attachment mechanism.

12. An attachment according to claim 11 wherein said attachment mechanism comprises:

a first clip element coupled to said first end of said under belt; and a second clip element attached to said second end of said under belt whereby said first and second clip elements may selectively attach to said chains.

13. A safety attachment for a playground swing, the swing including a belt seat depending from a swing set structure by a pair of chains, the safety attachment comprising:

a closed waist belt defining an upper opening of said cavity;

an under belt having first and second ends intersecting corresponding left and right regions of said waist belt and securely attached to said waist belt at said left and right regions;

a crotch belt having first and second ends intersecting corresponding front and rear regions of said waist belt and securely attached to said waist belt at said rear region and slidably coupled to said waist belt at said front region;

a mesh panel occupying an area defined by said waist belt between said left and rear regions and including said rear region and said under belt to provide in conjunction with said waist belt, said under belt and said crotch belt a restraint structure defining a child receiving cavity; and an attachment mechanism coupling said restraint structure to said chains to position said cavity at said belt seat in such manner to restrict falling movement of a child residing within said cavity.

14. An attachment according to claim 13 wherein said waist belt includes a buckle permitting selective closure of said waist belt and also adjustment in size of said opening.

* * * * *